US006371674B1

(12) United States Patent
Lerner

(10) Patent No.: US 6,371,674 B1
(45) Date of Patent: Apr. 16, 2002

(54) PLAQUE DISCLOSING AGENT DISPENSING TOOTHBRUSH

(76) Inventor: Sharon Lerner, 24 Pilidovski Street, Ramat Aviv, Tel Aviv (IL)

( * ) Notice: Subject to any disclaimer, the term of this patent is extended or adjusted under 35 U.S.C. 154(b) by 0 days.

(21) Appl. No.: 09/705,791

(22) Filed: Nov. 6, 2000

(51) Int. Cl.[7] ..... B43K 5/04
(52) U.S. Cl. ..... 401/155; 401/137; 401/160
(58) Field of Search ..... 401/137, 155, 401/156, 158, 160, 284

(56) References Cited

U.S. PATENT DOCUMENTS 3,734,106 A * 5/1973 Zimmerman ..... 132/311
4,459,277 A * 7/1984 Kosti ..... 424/9.71
4,963,046 A * 10/1990 Eguchi ..... 401/160

* cited by examiner

*Primary Examiner*—Gregory L. Huson
*Assistant Examiner*—Peter deVore
(74) *Attorney, Agent, or Firm*—Mark M. Friedman

(57) ABSTRACT

A plaque disclosing agent dispensing toothbrush is disclosed. The plaque disclosing agent disposing toothbrush includes: (a) a handle, the handle including a head portion and a grasping portion, an upper surface and a lower surface, and a hollow interior defining a reservoir, the reservoir being designed and constructed to contain dental plaque disclosing agent; (b) a plurality of bristles positioned on and attached to the upper surface of the head portion of the handle; (c) a conduit in communication with the reservoir and extending into the head portion, the conduit being connected to and terminating at an outlet aperture in the head portion; and (d) a dispensing mechanism operationally connected to the conduit and adapted to control flow through the conduit.

8 Claims, 1 Drawing Sheet

PLAQUE DISCLOSING AGENT DISPENSING TOOTHBRUSH

FIELD AND BACKGROUND OF THE INVENTION

The present invention relates to a toothbrush and, more particularly, to a toothbrush which stores and dispenses a plaque disclosing agent.

Dental disease is today the most common of all human diseases worldwide. An enormous proportion of the American population suffers from dental caries (tooth decay or cavities) and periodontal (gum and bone) disease. Dental caries are virtually ubiquitous: they begin soon after teeth erupt and increase in prevalence with age. The most recent survey, conducted in 1986–7, showed that the average school-aged child has at least one cavity in permanent teeth by age 9 and 8 by age 17. Approximately one in four schoolchildren has five or more decayed, filled, or missing teeth. The average American adult has 10–17 decayed, filled or missing teeth. Furthermore, periodontal diseases are the most prevalent chronic diseases affecting children, adolescents, adults and the elderly. Approximately half of all adults in the U.S. have gingivitis (inflammation of the gums), the first stage of gum disease, and 80% have had some degree of gum inflammation that has led to the destruction of the bone which supports the teeth (periodontitis), which, as if it progresses can lead to tooth loss. Gingivitis was observed in approximately 60 percent of children, while 95% of the elderly have periodontitis. Over half of all adults over age 65 are toothless. In 1989, in the U.S., dental disease caused 51 million hours of missed school, 164 million hours of missed work and 41 million days of restricted activity. Dental expenditures in the U.S. in 1990 were over $30 billion. (U.S. Preventive Services Task Force, Guide to Clinical Preventive Services, Second Edition, 1996) In addition recent research indicates a high correlation between periodontal disease and cardiovascular disease, heart attack, stroke and low-birthweight babies.

Dental plaque is a gelatinous mass or film of bacteria within a matrix of food particles and other organic materials such as mucins. It adheres to and builds up on the surfaces of teeth and is a major cause of both dental caries and periodontal disease. Prevention of dental disease involves oral hygiene practices. Good oral hygiene includes the effective and complete removal of substantially all plaque. Plaque that remains on the teeth calcifies to form calculus or tartar. It is important to remove plaque before it calcifies into calculus that requires more extensive care for its removal, usually by a dental health professional.

Personal oral hygiene practices such as toothbrushing and flossing can prevent the development and progression of periodontal disease by removing plaque. Professional dental care alone is inadequate to prevent periodontal disease. The single most important tool for preventing dental disease is the toothbrush. In the absence of personal plaque removal, after 10 to 21 days, gingivitis develops in healthy adults. This provides strong evidence for the recommendations for at least daily toothbrushing. Other studies confirmed that effective plaque removal every 48 hours was associated with gingival health. The efficacy of personal oral hygiene measures though is dependent upon the ability of the patient to do them effectively, that is to keep the teeth adequately plaque-free. Due to the difficulty many patients have in adopting and maintaining good oral hygiene habits these measures often fail to remove plaque adequately and prevent gum disease. (U.S. Preventive Services Task Force, Guide to Clinical Preventive Services, Second Edition, 1996, and Ismail, A. I., Lewis, D. W., Dingle, J. L. Prevention of Periodontal Disease, in Canadian Guide to Clinical Preventive Health Care, Ottawa: Health Canada, 1994; 420–431). It is important that the patient continue to be motivated to maintain oral hygiene habits. It is important for oral health professionals to counsel patients about the importance of oral hygiene habits and to instruct them in the guidelines for proper effective toothbrushing.

It is also often difficult for the patient to ensure that plaque removal is complete because the patient cannot easily determine (either visually or otherwise) whether all the plaque has been removed. Plaque is translucent or tooth-colored and not therefore visible. This problem can be surmounted through the use of plaque disclosing agents.

These agents have been used for over 80 years and generally consist of a dye that stains only the plaque and renders it visible in contrast to other oral structures. Disclosing agents come in a variety of forms including solutions that can be topically applied by dental personnel or with which the patient rinses, as well as chewable tablets, lozenges, wafers and powders. A variety of substances have been used in disclosing agents including iodine, basic fuchsin neutral red, erythrosine (e.g., FDC Red No. 3), and others. Some dyes used in the past have had a number of limitations including that they were suspected carcinogens, appeared in the urine or had an unpleasant taste. An appropriate dye should not be long lasting, should be easily removed and should not stain the skin or mucosa to any significant extent. It should not only have a pleasing shade but also allow for effective contrast with surrounding oral tissues. Some dental health professionals feel that a minor drawback to the use of the popular FDC Red No. 3 is that it has poor contrast with oral tissues such as the gingivae. Brown dyes have an unappealing appearance and have been found to be distasteful to users. Some disclosing agents are mixtures of two dyes that further reveal the age and thickness of the plaque. Such an agent is taught in U.S. Pat. No. 3,723,613 to Block et. al. The agents disclosed are mixtures of dyes such as FDC Red No. 3 and either FDC Blue No. 1, FDC Green No. 3 or Hercules Green Shade 3. These allow for the differential staining of thin and thick plaque, whereby the thin plaque is stained red and the thicker blue or green.

Patients are usually instructed to brush their teeth in their usual manner and then disclose any remaining plaque through use of the disclosing agent. Then they can brush again until all the stained areas of plaque have been removed. Use of disclosing agents are very effective also for counseling and educating patients in the proper techniques for brushing and plaque removal and for motivating patients to maintain their oral hygiene habits.

In British Patent No. 2019215 to Frysh it is taught that a disclosing agent may be included in a dentrifice or toothpaste. The disclosing agent in the Frysh patent includes mixtures of dye that result in the plaque being disclosed as a green color, and the preferred agent was formed by a mixture of Sulphan Blue and Tartrazine Yellow. A plaque disclosing dentifrice containing a mixture of dyes is also taught in U.S. Pat. No. 4,459,277 to Kosti and in U.S. Pat. No. 5,862,559 to Hunter.

It has been recognized that proper oral hygiene habits are often neglected. Reasons for this include that it is often perceived as time consuming and inconvenient. It requires storing, carrying, finding and having available both toothbrush and dentifrice (toothpaste). For these reasons the prior art is crowded with many descriptions of toothbrush devices which store and dispense toothpaste in an attempt to address these problems. Several are also adapted to dispense other oral hygiene products such as dental floss. Known prior art combination toothpaste dispensing toothbrushes include U.S. Pat. No. 4,865,481 to Scales, U.S. Pat. No. 5,827,001 to Taghavi-Khanghah, U.S. Pat. No. 5,832,940 to Embry et. al., U.S. Pat. No. 5,911,532 to Evancic, U.S. Pat. No. 5,915,868 to Frazell, U.S. Pat. No. 5,921,692 to Weber, U.S. Pat. No. 6,027,273 to Li, U.S. Pat. No. 6,056,466 to Johnson et. al., U.S. Pat. No. 6,050,736 to Gonzalez, U.S. Pat. No. 6,056,469 to Algorri, and U.S. Pat. No. 6,095,710 to Ayeni. The devices heretofore devised are known to consist basically of familiar, expected and obvious structural configurations, notwithstanding the myriad of designs encompassed by the crowded prior art which have been developed for the fulfillment of countless objectives and requirements. There are fine differences among them employed to distinguish the inventions from one another and to overcome associated problems. Because toothpaste is a viscous substance, most have specialized dispensing mechanisms such as screw driven pistons suitable for delivering this type of substance. All deliver the dentifrice onto the brushhead and bristles. Other individualized features relate to whether the toothbrush is meant to be of limited use and economically disposable or alternatively refillable and reusable. Many of these toothbrushes suffer from disadvantages including that they have complex mechanical features, do not resemble a conventional toothbrush, and are meant for only single or very limited number of uses.

Using a disclosing agent is also inconvenient for the individual as the separate container of disclosing agent must be stored, found and used. Of the abovementioned devices, the only such device designed for dispensing of disclosing agent described in the prior art is described in U.S. Pat. No. 4,543,679 to Rosofsky et. al. The device of Rosofsky et. al. is a toothbrush wherein an oral hygiene device can be attached to the tail end of the handle. The oral hygiene devices taught by Rosofsky et. al. include a porous pad, which can hold a disclosing agent, or a reservoir that can hold a dry powder or solid form of disclosing agent. This device does not hold a solution of disclosing agent and is not useful for convenient multiple applications without re-immersion of the pad in the agent. Thus it does not address the primary object of the device to provide a convenient source of the disclosing agent which does not require storing and having available a separate source of disclosing agent. Further it does not deliver the agent to the head of the toothbrush (though it does avoid delivery onto the bristles) and does not resemble a familiar, conventional, commercial toothbrush. Dentifrices that contain disclosing agent have the limitation that they continuously apply the agent throughout the brushing process that makes it difficult to visualize only the plaque-covered areas while brushing. This is also a problem whenever the agent is delivered directly onto the brushes. It is most desirable to be able to separately dispense disclosing agent whenever one wants, including before or after brushing. Furthermore, it is desirable to be able to use a disclosing agent with any toothpaste of the patient's and dentist's choice.

In the process of patient counseling and education, dentists frequently provide a toothbrush to their patients and demonstrate proper brushing techniques. It would be desirable to have a toothbrush that stores and dispenses a disclosing agent that the dentist could supply to the patient. This would enhance the ability of the dentist to demonstrate and teach the patient how to brush effectively and enable the patient to continue doing so. In this way, because the disclosing agent is integrated with the familiar toothbrush, the disclosing agent will seem less foreign, frightening and inconvenient, and the patient will be more likely to be complaint with proper oral hygiene habits. The brush should be inexpensive, carry a supply of agent suitable for use for period of about 3 months, dispense the agent at the head end of the toothbrush but not onto the bristles, and resemble a conventional toothbrush.

There is thus a widely recognized need for, and it would be highly advantageous to have, a toothbrush which stores and dispenses a plaque disclosing agent, that meets these requirements and that is devoid of the limitations described above.

SUMMARY OF THE INVENTION

According to the present invention there is provided a plaque disclosing agent dispensing toothbrush comprising: (a) a handle, the handle including a head portion and a grasping portion, an upper surface and a lower surface, and a hollow interior defining a reservoir, the reservoir being designed and constructed to contain dental plaque disclosing agent; (b) a plurality of bristles positioned on and attached to the upper surface of the head portion of the handle; (c) a conduit in communication with the reservoir and extending into the head portion, the conduit being connected to and terminating in an outlet aperture in the head portion; and (d) a dispensing mechanism operationally connected to the conduit and adapted to control flow through the conduit.

According to further features in preferred embodiments of the invention described below, the plaque disclosing agent dispensing toothbrush further includes a significant quantity of a dental plaque disclosing agent contained within the reservoir.

According to still further features in the described preferred embodiments the significant quantity is at least a three months supply.

According to still further features in the described preferred embodiments the dental plaque disclosing agent is a dental plaque disclosing solution.

According to still further features in the described preferred embodiments the dental plaque disclosing agent includes a dye containing erythrosine.

According to still further features in the described preferred embodiments the dental plaque disclosing agent includes a mixture of Sulphan Blue and Tartrazine Yellow.

According to still further features in the described preferred embodiments the handle is at least partially transparent.

According to still further features in the described preferred embodiments, the dispensing mechanism is a peristaltic pump.

According to still further features in the described preferred embodiments, the outlet aperture is located on the lower surface of the head portion of the handle.

The present invention successfully addresses the shortcomings of the presently known configurations by providing a dental plaque disclosing agent dispensing toothbrush in which the disclosing agent is integrated with a familiar toothbrush, In this way the disclosing agent will seem less foreign, frightening and inconvenient, and the patient will be more likely to be complaint with proper oral hygiene habits. The plaque disclosing agent dispensing toothbrush according to the present invention will be inexpensive to manufacture, be capable of storing a supply of agent suitable for use for a period of about 3 months, dispense the agent at the head end of the toothbrush but not onto the bristles, and resemble a conventional toothbrush.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
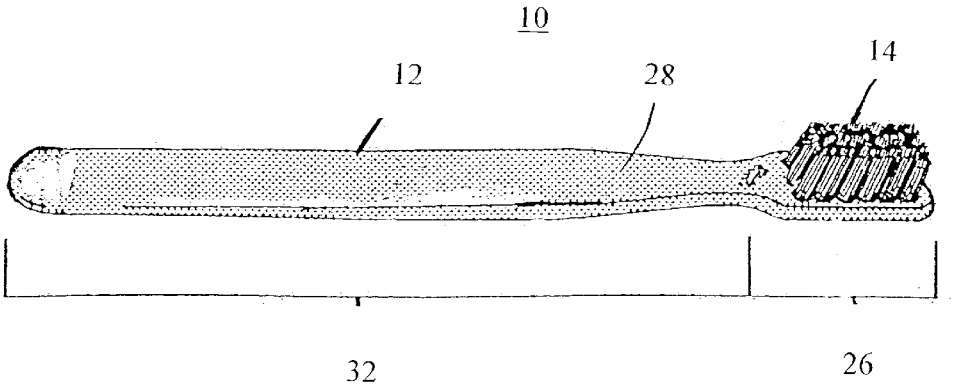
FIG. 1 is a perspective view of the toothbrush according to the present invention.

The present invention is of a toothbrush which can store and dispense a plaque disclosing agent. Specifically, the present invention resembles a conventional toothbrush and can be used to store a supply of plaque disclosing agent suitable for use for an extended period of time and dispense the agent at the head end of the toothbrush but not onto the bristles.

The principles and operation of a plaque disclosing agent dispensing toothbrush according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Figure 2:
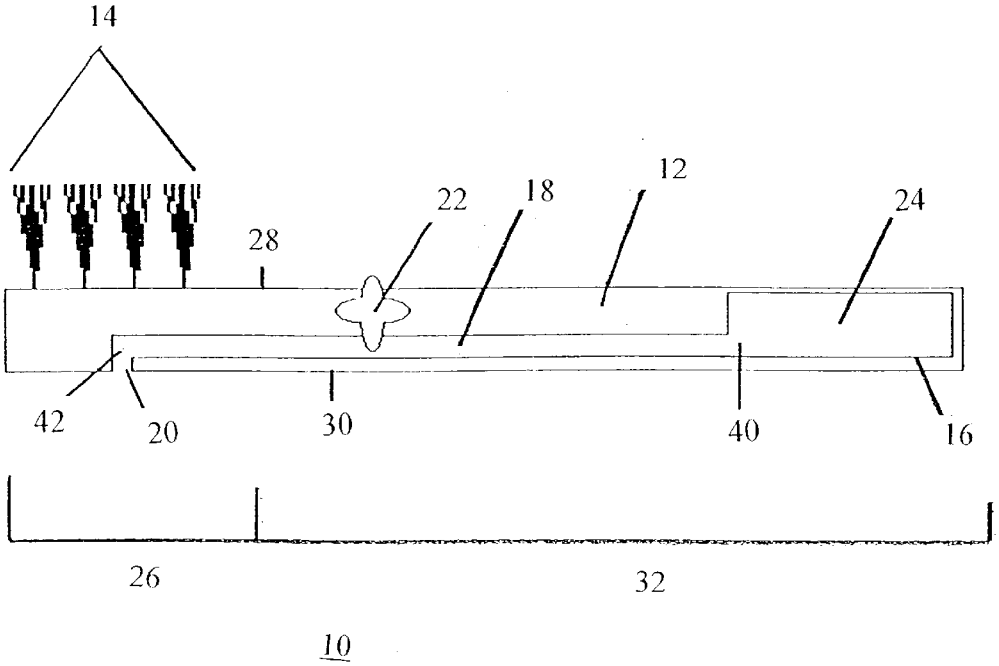
FIG. 2 is a cross sectional schematic diagram illustrating the elements of a plaque disclosing agent dispensing toothbrush according to the present invention; and, FIG. 3 illustrates a preferred embodiment of a dispensing mechanism according to the present invention.

Referring now to the drawings, FIGS. 1 and 2 illustrates the plaque disclosing agent dispensing toothbrush embodying the principles and concepts of the present invention which is generally designated by the reference numeral 10. Plaque disclosing agent dispensing toothbrush 10 resembles a conventional ordinary toothbrush.

As shown in FIG. 1, plaque disclosing agent dispensing toothbrush 10 includes a handle 12 with a head portion 26 and a grasping portion 32. A plurality of bristles 14 are positioned on and attached to the upper surface 28 of head portion 26. Head portion 26 has the appearance of a typically constructed toothbrush head, and is substantially flat with the plurality of bristles 14 implanted therein in clusters or tufts of bristles such that plurality of bristles 14 radially project perpendicularly upward therefrom. Bristles 14 are generally equally spaced in a plurality of rows. Bristles 14 have a density sufficient to obtain a good cleaning effect. Bristles 14 are usually made of plastic such as nylon, and are preferably transparent.

Handle 12 is a generally flat, elongated, straight, substantially rectangular member having formed therein a hollow interior cavity creating a reservoir 16 for storing therein a plaque disclosing agent 24, as illustrated schematically in FIG. 2. Handle 12, and in particular grasping portion 32 may be any shape suitable for the handle to be comfortably yet firmly grasped by the user. The size of handle 12 is such that it may be comfortably and firmly gripped, but also of sufficient size that reservoir 16 therein can be of dimensions such that it holds a suitable amount of disclosing agent 24. The quantity of agent contained preferably is of an amount that would last as long as the bristles last before they become worn out and at which time it is recommended that the brush should be replaced. This is preferably at least one month, more preferably at least 2 months, most preferably about 3 months or longer. Based on the concentration of the plaque disclosing agent, as is further described hereinbelow, this volume will vary, but is preferably approximately 5 ml. One of ordinary skills in the art would know how to operatively assemble these components and introduce the plaque disclosing agent into the reservoir using for example, existing methods of injection molding and known methods of introduction of a fluid medium into a chamber. The handle may be made from any biologically compatible and structurally durable material, such as a plastic (e.g., a polyethylene or a polyvinyl chloride.) In a preferred embodiment of the present invention, handle 12 may be constructed at least partially of transparent materials so as to allow a user to ascertain the presence and quantity of disclosing agent contained therein. The distal end 40 of reservoir 16 is fixably coupled to and in communication with a tubular conduit 18 which extends from reservoir 16 along handle 12 into head portion 26 of toothbrush 10.

At the distal forward end 42 of conduit 18 in head portion 26, conduit 18 terminates at an outlet aperture 20. Outlet aperture 20 opens onto the lower surface 30 of the handle opposite to the upper surface 28 with the plurality of bristles 14 implanted therein. The size and the precise placement of the aperture on the lower surface of the head portion can vary. Preferably the size of the aperture is about that of a pinhole or approximately 0.01–0.02 inches in diameter. This size of aperture 20 is such that it is a barrier to unwanted egress of fluid from the aperture.

Figure 3:
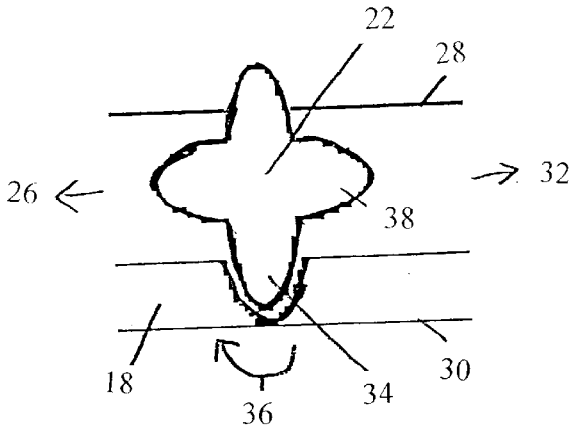

A dispensing mechanism 22 is operatively connected to and acts upon conduit 18. Dispensing mechanism 22 (FIG. 3) is operable by the user to control the flow of the plaque disclosing agent through the conduit. Mechanism 22 functions to dispense the desired quantity of disclosing agent and to otherwise seal the conduit so as to prevent the leakage and egress of the agent from the toothbrush. One of ordinary skill in the art would know how to operatively assemble such a dispensing mechanism from commercially available components. A non-limiting example of a configuration of such a dispensing mechanism 22 is illustrated in greater detail in FIG. 3. As illustrated in FIG. 3, such a dispensing mechanism can take the form of a peristaltic pump. In such an embodiment, conduit 18 is flexible and compressible. Dispensing mechanism 22 takes the form of a rotating wheel with a plurality of spokes (34 and 38 are indicated) which can impinge upon and compress conduit 18. In the fully closed position, as is illustrated in FIG. 3 one spoke (34) fully compresses conduit 18 and seals the conduit so as to prevent the leakage and egress of the agent from the toothbrush. When the wheel is rotated (as indicated by arrow 36 in FIG. 3) spokes 34 and 38 gradually roll along the conduit squeezing it and press and propel forward the desired drop of the fluid by peristaltic action.

Alternate configurations in which dispensing mechanism 22 is of another type of valve are within the scope of the present invention. Further envisioned as being within the scope of the present invention are alternate configurations wherein aperture 20 is constructed in the manner of the tip of a conventional squeeze bottle, and at least a portion of handle 12 is flexible and compressible. In such a configuration, dispensing mechanism 22 is the compressible part of handle 12, wherein, as this compressible portion is pressed inward, the handle functions to squeeze out a drop of the contents of the reservoir therein, in the same manner of operation as a conventional squeeze bottle. The compressible portion is further constructed, as is a squeeze bottle, such that it returns to its initial position on release of the compression.

The plaque disclosing agent 24 contained within reservoir 16 can be a commercially available plaque disclosing solution such as Red-Cote® (Dental Disclosing Solution, D& C Red #28, 15%, John O. Butler Co., Chicago, Ill. 60630), or it can be a specifically designed solution. Preferably the solution is highly concentrated, such that one drop (50 microliters) is sufficient. In other configurations different forms such as gels or powders may substitute for the solution. Preferably the dye agent used should have a predominantly red or a predominantly green or yellow color. Preferably the dye agent used should not be overly long lasting, should be easily removable by rinsing and should stain only plaque and not surrounding oral tissues. This can be achieved using a 15% solution of erthyrosine (e.g., FDC Red No. 3 or FDC Red #28) or a combination of dye agents such as a mixture of Sulphan Blue and Tartrazine Yellow, which can be mixed into a composition in an amount by weight of 0.2 to 0.45% and 0.04 to 0.1% respectively.

As to a further discussion of the manner of usage and operation of the present invention, the same should be apparent from the above description. Accordingly, no further discussion relating to the manner of usage and operation will be provided.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A plaque disclosing agent dispensing toothbrush comprising:

(a) a handle, said handle comprising a head portion and a grasping portion, an upper surface and a lower surface, and a hollow interior defining a reservoir, said reservoir being designed and constructed to contain dental plaque disclosing agent;

(b) a plurality of bristles positioned on and attached to said upper surface of said head portion of said handle;

(c) a conduit in communication with said reservoir and extending into said head portion, said conduit being connected to and terminating in an outlet aperture in said head portion;

(d) a dispensing mechanism operationally connected to said conduit and adapted to control flow through said conduit; and (e) a quantity of a dental plaque disclosing agent in a non-dentifrice solution contained within said reservoir.

2. The toothbrush of claim 1, wherein said dental plaque disclosing agent comprises a dye containing erythrosine.

3. The toothbrush of claim 1, wherein said dental plaque disclosing agent comprises a mixture of Sulphan Blue and Tartrazine Yellow.

4. The toothbrush of claim 1, wherein said handle is at least partially transparent.

5. The toothbrush of claim 1, wherein said dispensing mechanism is a peristaltic pump.

6. The toothbrush of claim 1, wherein said outlet aperture is located on said lower surface of said head portion of said handle.

7. The toothbrush of claim 1, wherein said solution contains said dental plaque disclosing agent in a concentration such that effective plaque disclosure is achieved by delivery of approximately one drop of said solution.

8. The toothbrush of claim 1, wherein a concentration of said solution and a quantity of said solution contained within said reservoir are chosen such that said solution includes at least about 100 times a quantity of said dental plaque disclosing agent required for effective plaque disclosure.

* * * * *